United States Patent [19]

Kroll

[11] 3,977,356

[45] Aug. 31, 1976

[54] STERN DRIVE UNIT AND TRANSMISSION THEREFOR

[75] Inventor: Raymond A. Kroll, Kenosha, Wis.

[73] Assignee: Outboard Marine Corporation, Waukegan, Ill.

[22] Filed: May 16, 1975

[21] Appl. No.: 578,120

[52] U.S. Cl. ..... 115/35

[51] Int. Cl.[2] ..... B63H 5/12

[58] Field of Search ..... 115/34 R, 35, 41 R

[56] References Cited

UNITED STATES PATENTS

| | | | |
|---|---|---|---|
| 3,339,517 | 9/1967 | Bergstedt | 115/35 |
| 3,556,040 | 1/1971 | Strang | 115/34 R |
| 3,605,678 | 9/1971 | Shimanckas | 115/35 |
| 3,826,219 | 7/1974 | Nossiter | 115/35 |

*Primary Examiner*—Trygve M. Blix
*Assistant Examiner*—Stuart M. Goldstein
*Attorney, Agent, or Firm*—Michael, Best & Friedrich

[57] ABSTRACT

Disclosed herein is a stern drive unit comprising a bracket adapted to be fixed relative to a boat hull, an intermediate portion supported by trunnions from the bracket for movement about a tilt axis, a steerable part which carries a propeller and which is supported by bearings from the intermediate portion for common tilting movement and for steering movement relative thereto about a steering axis, a transmission including a cross shaft supported by the bracket for rotary movement coaxial with the tilt axis and for axial movement relative to the bracket, an output gear splined to the cross shaft for rotation in common therewith and for relative axial movement therebetween, supported against axial movement and drivingly connected to the propeller, a driving member rotatably driven by a power source and supported by the bracket in coaxial relation to the cross shaft, a selectively operable coupling for connecting the driving member to the cross shaft for common rotary movement in response to axial movement of the cross shaft, and a shift lever for selectively axially shifting the cross shaft so as thereby to rotationally couple the driving member and the cross shaft, and a linkage for steering the steerable part including a steering member rotatably supported about an axis co-planar with the steering axis, and pin and slot connections between the steering member and the steerable part and located transversely outwardly of the trunnions.

26 Claims, 3 Drawing Figures

15
105
95
93
23
33
83
11
17
181
19
19
79
177
179
125
81
31
147
121
77
85
175
130
123
43
21
149
41
85
47
53
75
51
45
67
44
13

STERN DRIVE UNIT AND TRANSMISSION THEREFOR

BACKGROUND OF THE INVENTION

The invention relates generally to marine propulsion devices, and more particularly, to stern drive units.

The invention also relates to steering arrangements for stern drive units.

The invention also relates to transmissions and particularly to transmissions for marine propulsion devices.

Attention is directed to the United States Strang U.S. Pat. Nos. 3,489,120 issued Jan. 13, 1970, and 3,556,040 issued Jan. 19, 1971, and to the United States Schmanckas U.S. Pat. Nos. 3,583,357 issued June 8, 1971, and 3,847,108 issued Nov. 12, 1974.

SUMMARY OF THE INVENTION

The invention provides a stern drive unit comprising a first portion adapted to be fixed relative to a boat hull and extending aft of the transom of the boat hull, a second portion, means supporting the second portion from the first portion for movement relative to the first portion about a horizontally extending transverse tilt axis, a third portion, means supporting the third portion from the second portion for common tilting movement and for rotation of the third portion relative to the second portion about a steering axis perpendicular to the tilt axis, which third portion includes a propeller shaft, a propeller carried by the propeller shaft and normally located under water, a drive shaft, and gearing connecting the drive shaft and the propeller shaft, an input shaft rotatably supported by the first portion, and a transmission including a cross shaft supported by the first portion for rotary movement coaxial with the tilt axis and for axial movement relative to the first portion, an output gear supported by the second portion for rotation in coaxial relation to the cross shaft, against movement axially relative to the second portion, and in driving connection with the drive shaft, means on the output gear and on the cross shaft for effecting common rotary movement of the cross shaft and the output gear and permitting axial movement of the cross shaft relative to the output gear, a driving member driven by the input shaft and supported by the first portion in co-axial relation to the cross shaft, means on the driving member and on the cross shaft for selectively coupling the driving member to the cross shaft for common rotary movement in response to axial movement in one direction of the cross shaft, and means on the first portion and operatively engaged with the cross shaft for selectively axially shifting the cross shaft so as thereby to rotationally couple the driving member and said cross shaft.

In one embodiment in accordance with the invention, the cross shaft includes a clutch part having a conical clutch surface and a non-cylindrical surface, the driving member comprises a bevel gear member including a bevel gear portion in mesh with a driving bevel gear fixed on the input shaft and an apertured portion having a non-cylindrical surface adapted to drivingly receive the non-cylindrical surface of the clutch part of the cross shaft in response to axial movement of the cross shaft toward the bevel gear member, and a clutch element mounted on the bevel gear member for common rotary movement and for relative axial movement therebetween and including a conical clutch surface adapted to engage and to drive the clutch surface of the clutch part of the cross shaft in response to movement of the cross shaft toward the bevel gear member and prior to receipt of the non-cylindrical surface of the clutch part by the non-cylindrical surface of the bevel gear member, whereby axial shifting of the cross shaft initially engages the conical surface to rotate the cross shaft in common with the bevel gear member and thereafter drivingly engages the non-cylindrical surfaces. Preferably, there is also provided means yieldably biasing the clutch element in the direction toward the clutch part of the cross shaft.

In one embodiment in accordance with the invention, the means for selectively axially shifting the cross shaft comprises an annular groove in the cross shaft and a shifting lever rotatably mounted on the first portion and including, at one end, a part extending forwardly of the first portion and, at the other end, a part engaged in the annular groove, whereby arcuate movement of the shifting lever effects axial movement of the cross shaft.

In one embodiment in accordance with the invention, the means for supporting the second portion from the first portion comprises a pair of laterally spaced co-axial trunnion parts extending from the first portion and each having an inner cylindrical surface an an outer cylindrical surface, the second part is rotatably mounted on the outer cylindrical surfaces, the driving member is rotatably mounted on one of the inner cylindrical surfaces, and the cross shaft is supported by the trunnion parts.

In one embodiment in accordance with the invention, the means for steering the third portion relative to the second portion comprising a linkage including a steering member rotatably supported by the first portion about an axis co-planar with the steering axis, and means located co-axially with the tilt axis when the third portion is located for straight ahead movement for connecting the steering member and the third portion so as to effect steering of the third portion in response to steering movement of the steering member.

In one embodiment in accordance with the invention, the first portion includes a generally downwardly and rearwardly open, partially spherical first housing part, and the third portion has mounted thereon a generally upwardly and forwardly open, partially spherical second housing part movably engaged with the first housing part to define a housing containing the transmission, the means pivotally supporting the second portion from the first portion, and the means connecting the steering member and the third portion, and wherein the input shaft, the drive shaft, the cross shaft shifting means and the steering member extend into the housing.

The invention also provides a stern drive unit comprising a first portion adapted to be fixed relative to a boat hull and extending aft of the transom of the boat hull, a second portion, means supporting the second portion from the first portion for movement relative to the first portion about a horizontally extending transverse tilt axis, a third portion supported by the second portion for common tilting movement and for rotation of the third portion relative to the second portion about a steering axis perpendicular to the tilt axis, and means for steering the third portion relative to the second portion comprising a linkage including a steering member rotatably supported by the first portion about an axis co-planar with said steering axis, and means located co-axially with the tilt axis when the third portion is located for straight ahead movement for connecting the steering member and the third portion so as to effect steering of the third portion in response to steering movement of the steering member.

In one embodiment in accordance with the invention, the steering member includes two downwardly extending transversely spaced upwardly extending arms, and the connecting means is located transversely outwardly of the means tiltably supporting the second portion from the first portion and connects the transversely spaced legs of the steering member with the transversely spaced arms of the third portion for effecting steering movement of the third portion in response to steering movement of the steering member while otherwise permitting lost motion between the legs and the arms.

Preferably, the connecting means comprises association of one of the legs with one of the arms and association of the other of the legs with the other of the arms, with each associated pair of arms and legs being provided with a slot in one of the associated arm and leg and a pin extending from the other of the associated arm and leg and into the slot in the one of the associated arm and leg.

The invention also cross a transmission for a marine propulsion device, which transmission includes a support, a cross shaft mounted by the support for rotary and axial movement relative to the support, an output gear mounted by the support for rotation in co-axial relation to the cross shaft and against movement axially relative to the support, means on the output gear and on the cross shaft for effecting common rotary movement of the cross shaft and the output gear and permitting axial movement of the cross shaft relative to the output gear, a driving member mounted by the support for rotation relative to the support in co-axial relation to the cross shaft, means on the driving member and on the cross shaft for selectively coupling the driving member to the cross shaft for common rotary movement in response to axial movement in one direction of the cross shaft, and means mounted by the support and operatively engaged with the cross shaft for selectively axially shifting the cross shaft so as thereby to rotationally couple the driving member and the cross shaft.

One of the principal features of the invention is the provision of a stern drive unit including a pair of trunnions which tiltably support a lower steerable unit and which also support at least some of the components of a reversing transmission arranged co-axially with the tilt axis.

Another of the principal features of the invention is the provision of a stern drive unit including a partially spherical housing containing a pair of trunnions which tiltably support a lower steerable unit and which also support at least some of the components of a reversing transmission arranged co-axially with the tilt axis.

Still another of the principal features of the invention is the provision of a stern drive unit which incorporates the features referred to in the two preceding paragraphs.

Still another of the principal features of the invention is the provision of a stern drive unit incorporating an arrangement of die cast parts or members in the region of the tilt axis, which arrangement allows use of a constant mesh transmission and a simple and efficient steering system.

Still another of the principal features of the invention is the employment of castings which are located in the vicinity of the tiltable axis and which are arranged in the form of movably engaged partial spheres to provide a completely enclosed housing containing a transmission about which the tiltable portion is tilted on trunnions such that all gears are constantly in mesh at all times including during tilting. This construction allows tilting to a greater height than, for example, if a U-joint is used.

Still another of the principal features of the invention is the projection into a partially spherical housing of a yoke part of the steerable portion, which yoke part includes slots which are engaged by pins connected to another yoke which extends into the spherical housing from inside the boat to provide a shift lever and to thereby provide a simple, efficient and economical steering system. In operation, the tiltable portion tilts about the pins when it is in the straight ahead position, and when steered to some angle and tilted, a certain amount of sliding occurs between the pins and the slots.

Another of the principal features of the invention is the provision of a novel transmission which is particularly adapted for marine propulsion uses and which is capable of transmitting large torque loading while nevertheless occupying a relatively small space.

Still another of the principal features of the invention is the provision of a transmission incorporating relatively low capacity cone clutches which sychronize the speed of a cross shaft with either the forward or reverse bevel gear upon initial movement of a shifting lever. After synchronization and as the shifting lever is moved even further, but before throttle is applied, one of the clutch elements is forced against a spring to allow engagement of a spline on the cross shaft with a spline on the bevel gear for transmitting greater torques. This construction provides a smoothly shifting transmission which has positive drive and which is more desirable than enlarging prior clutch constructions to enable increased torque transmissions.

Other features and advantages of the embodiments of the invention will become known by reference to the following general description, and claims, and the accompanying drawings.

DRAWINGS

Figure 1:
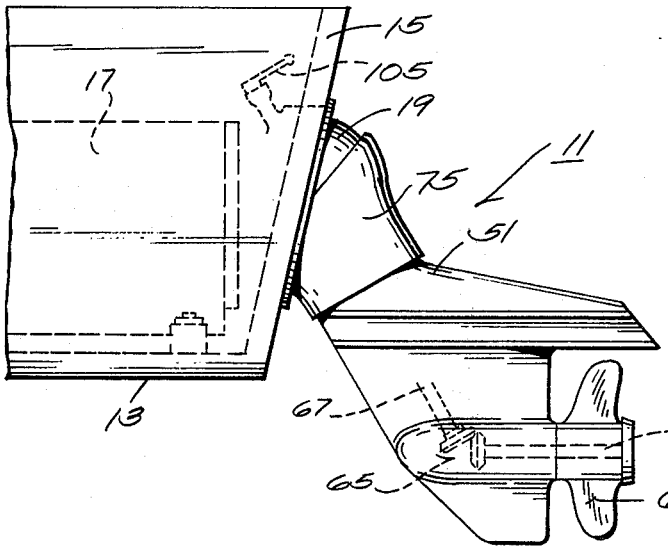
FIG. 1 is a fragmentary side elevational view of a boat mounted stern drive unit which incorporates various of the features of the invention.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for the purposes of description and should not be regarded as limiting.

GENERAL DESCRIPTION

Figure 2:
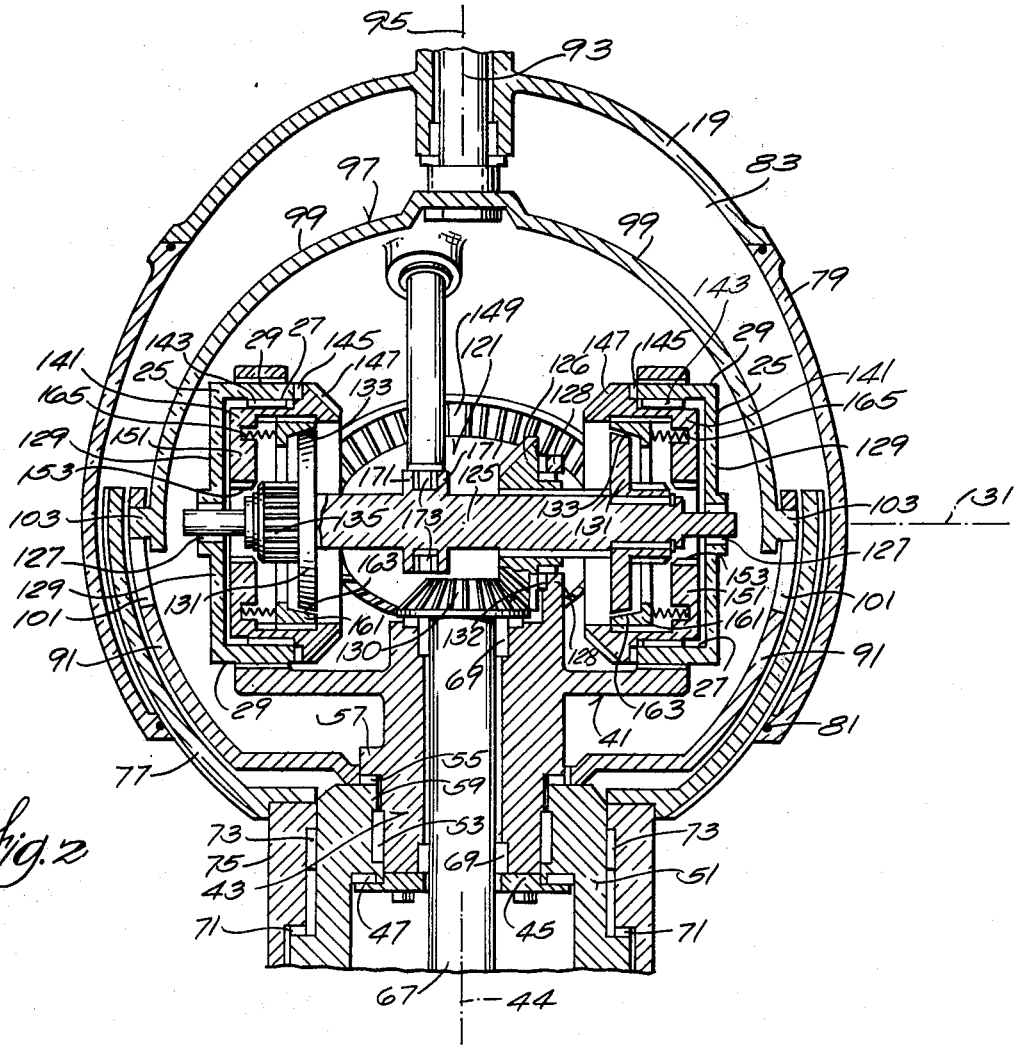
FIG. 2 is an enlarges schematic view of a portion of the stern drive unit shown in FIG. 1.
Figure 3:
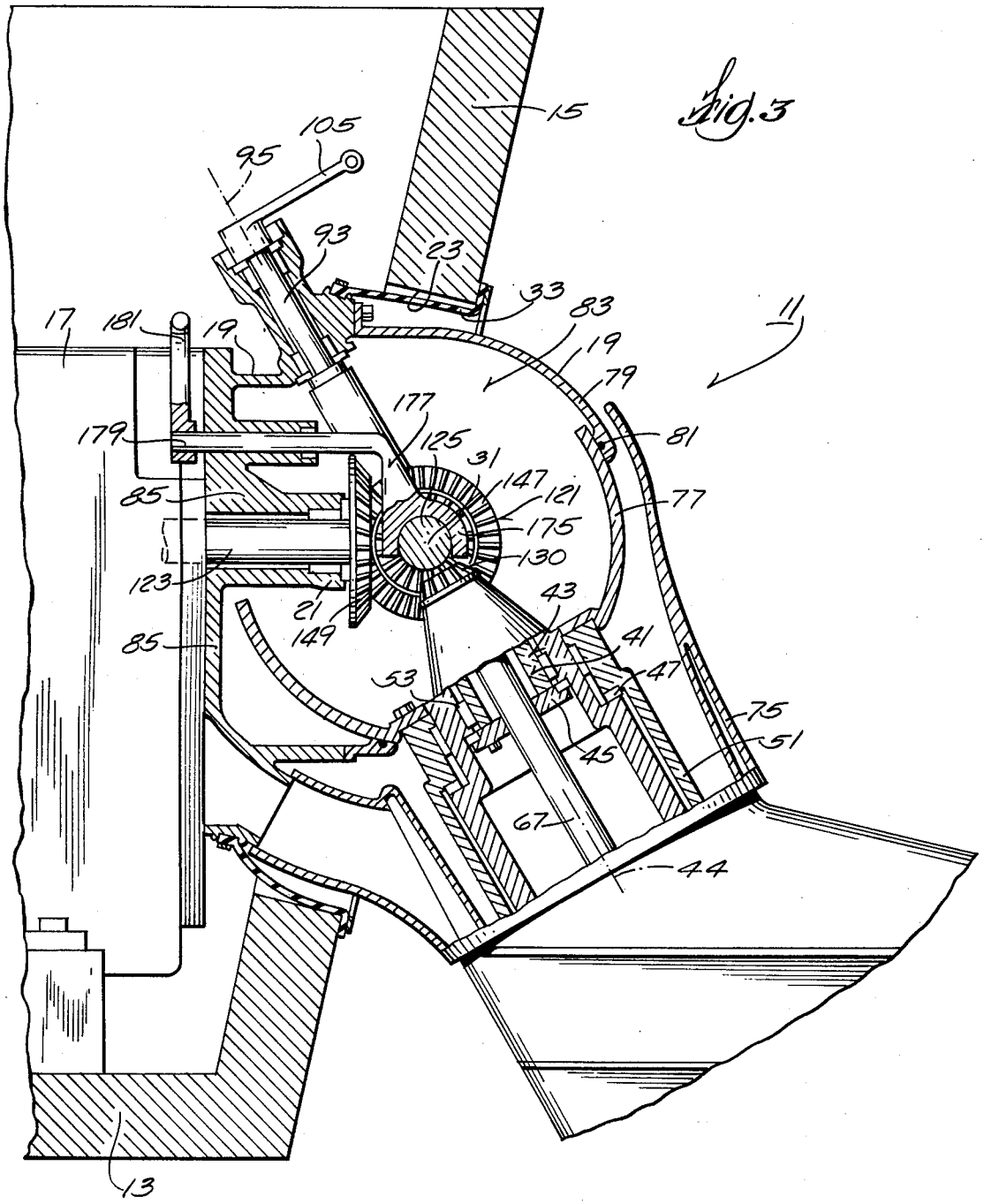
FIG. 3 is an enlarged fragmentary view, with parts broken away and in section, of the stern drive unit shown in FIG. 1.

Shown in the drawings is a marine propulsion device 11 in the form of a stern drive unit which is adapted to be mounted on or to a boat hull 13 having a transom 15. More particularly, the marine propulsion device 11 also includes, see FIG. 3, an engine 17 which is preferably resiliently mounted in the boat hull 13, together with the stern drive unit which includes a first portion 19 which is fixed relative to the boat hull 13 either through the engine 17 or by other suitable means. The first or fixed portion 19 preferably includes a member 21 which is preferably die cast as a single piece and which extends through an opening 23 in the transom 15 and which includes, aft of the transom (see FIG. 2), a pair of laterally or transversely spaced trunnion parts 25 which have co-axial inner and outer cylindrical surfaces 27 and 29 and which define a horizontally extending transverse tilt axis 31 which is fixed relative to the boat hull 13. In the illustrated construction, the fixed portion 19 of the stern drive unit is not supported directly from the transom 15, but is supported from the engine 17 and extends through the opening 23 in the transom 15. A suitable rubber member 33 (See FIG. 3) extends between the fixed portion 19 of the stern drive unit and the transom 15 to prevent entry of water into the boat hull 13.

Carried by the outer cylindrical surfaces 29 of the trunnion parts 25 is (See FIG. 2) a die cast member 41 which forms a part of a second or tiltable portion 43 which is tiltable relative to the first or fixed portion 19. Bolted or otherwise suitably fixed to the bottom of the tiltable member 41 is a support plate 45 which carries a thrust bearing 47 supporting a third or steerable portion 51 which tilts in common with the second or tilting portion 43, which is located in partially encircling relation to the tilt member 41 and which is steerable about an axis 44 extending perpendicularly to the tilt axis 31. Steering of the third portion 51 is also facilitated by bearings 53 between the steerable third portion 51 and the tiltable second portion 43. Axial movement of the third or steerable portion 51 relative to the second or tiltable portion 43 is prevented by a second thrust bearing 55 located between an annular shoulder 57 on the tiltable member 41 and a shoulder 59 on the steerable portion 51.

At its lower end, the steerable portion 51 rotatably supports a propeller shaft 61 which carries a propeller 63 and which is connected through suitable gearing 65 with a drive shaft 67 carried for rotation co-axially with the steering axis 44 by bearings (not shown) supported by the steerable portion 51 and by bearings 69 supported by the tiltable member 41.

Supported from the steerable portion 51 by a thrust bearing 71 and by a radial bearing 73 is an outer cover member 75 which generally encloses the upper portion of the steering portion 51 and which includes a generally upwardly and forwardly open partially spherical lower housing part 77. The cover member 75 is prevented from rotating about the steering axis 44 by reason of connection to the fixed portion 19 by one or more shock absorbers (not shown).

The lower housing part 77 cooperates with a generally downwardly and rearwardly open partially spherical upper housing part 79 which is connected by bolts or other suitable means to the fixed portion 18 and which thereby becomes a part of the fixed portion 19. An O-ring 81 is housed in the upper housing part 79 and engages the lower housing part 77 to complete a housing 83 which is sealed against entry of moisture through the interface between the fixed upper housing part 79 and the tiltable lower housing part 77.

Desirably, the fixed portion 19 of the stern drive unit includes a forwardly located wall 85 which serves to complete formation of the generally sealed housing 83 which is capable of retaining therein a suitable amount of lubricant which is therefore available to the trunnion parts 25, to the steering connection, and to the transmission still to be described.

Included in the stern drive unit is means for steering the steerable portion 51 relative to the tiltable and fixed portions 43 and 19, notwithstanding tilting of the tiltable and steerable portions 43 and 51. In this regard, the steerable portion 51 includes (See FIG. 2) two transversely spaced arms 91 which extend upwardly beyond the tilt axis 31 and outwardly of the laterally spaced trunnion parts 25. In addition, the stern drive unit includes a steering member 93 which is suitably journaled by the fixed portion 19 for arcuate movement about an axis 95 perpendicular to the tilt axis 31 and co-planar with the steering axis 44. The steering member 93 includes, at the lower end thereof, a yoke 97 including transversely spaced and downwardly extending legs 99 which project downwardly beyond the tilt axis 31 and outwardly of the laterally spaced trunnion parts 25.

Means are provided for connecting the legs 99 of the yoke 97 of the steering member 93 with the arms 91 of the steerable portion 51 to effect steering movement of the steerable portion 51 in response to steering movement of the steering member 43, notwithstanding tilting of the steerable portion 51 relative to the fixed portion 19. In the illustrated construction, such means comprises a vertically extending slot 101 in each of the arms 91 of the steerable portion 51 and pins 103 respectively extending from the legs 99 of the yoke 97 and into the slots 101. If desired, the yoke legs 99 could include the slots 101 and the pins 103 could extend from the arms 91 of the steerable portion 51. When the steering member 93 is positioned to afford straight forward travel, the pins 103 are located in generally co-axially relation to the tilt axis 31.

At its upper end, the steering member 93 projects from the fixed portion 19 of the stern drive unit within the boat hull 13 forwardly of the transom 15 and has fixed thereon (See FIG. 3) a steering lever 105 which can be suitably connected to a boat mounted steering system (not shown) of any desired construction. Accordingly, steering movement of the steering lever 105 effects steering movement of the steering member 93 which, in turn, effects steering movement of the steerable portion 51 of the stern drive unit.

Located within the housing 83 formed by the upper and lower housing parts 79 and 77 is a transmission 121 which is selectively operable to connect, to the previously described drive shaft 67, an input shaft 123 (See FIG. 3) driven by the engine 17 and rotatably supported by the fixed portion 19 of the stern drive unit.

More specifically, the transmission 121 includes a cross shaft 125, which, at its outer ends, is suitably journaled for rotary and axial movement relative to the fixed portion 19 by bearings 127 supported by the transversely outwardly located web portions 129 of the trunnion parts 25 of the fixed stern drive unit portion 19.

In addition, the transmission 121 also includes an output bevel gear 126 which is supported in a split bearing part 128 of the member 41 of the tiltable stern drive unit portion 43 for co-axial rotation with the cross shaft 125 and which is in mesh with a bevel gear 130 fixed to the upper end of the drive shaft 67.

Means are also provided for preventing axial movement of the output gear 126 relative to the tiltable portion 43. In this regard, such movement is prevented by engagement of the output gear 126 with the bevel gear 130 and with a thrust bearing 132 supported by the split bearing part 128.

Means are also provided for connecting the cross shaft 128 to the output bevel gear 126 to provide for common rotation and for relative axial movement of the cross shaft 125 relative to the output bevel gear 126. Thus, in the illustrated construction, the output bevel gear 126 and cross shaft 125 are connected by mating spline formations.

The transmission 121 also includes one or more drive members which are in the form of bevel gear members (still to be described) and means on the driving members and on the cross shaft 125 for selectively coupling the driving members to the cross shaft 125 for common rotary movement in response to axial movement of the cross shaft 125.

More specifically, the cross shaft 125 fixedly carries, in inwardly spaced relation from the ends thereof and from the trunnion parts 25, a pair of axially spaced clutch parts 131 which have common axial and rotary movement with the cross shaft 125.

Each of the clutch parts 131 includes a conical clutch surface 133 and a non-cylindrical surface 135 which is located radially inwardly with respect to the conical clutch surface 133 and in axially outwardly spaced relation from the conical clutch surface 133.

In the specifically disclosed construction, the transmission 121 includes a pair of transversely spaced drive members in the form of bevel gear members 141 which are supported by radial bearings 143 from the inner cylindrical surfaces 27 of the trunnion parts 25 so that the bevel gear members 141 are rotatable co-axially with and relative to the cross shaft 125. Each of the bevel gear members 141 is also supported for rotation by a thrust bearing 145. In addition, each of the bevel gear members 141 includes a bevel gear portion 147 which is in mesh with a common bevel gear 149 carried on the adjacent end of the input shaft 123. Thus, the bevel gear members 141 rotate in opposite directions relative to each other.

Each of the bevel gear members 141 also includes a portion 151 including means defining an aperture 153 which is generally aligned with the tilt axis 31 and which has a non-circular surface adapted to receive the non-circular surface 135 of the adjacent clutch part 131 so as to drivingly transmit rotary power from the bevel gear member 141 to the clutch part 131. In the illustrated construction, the non-circular surfaces 135 and 153 of the clutch part 131 and the bevel gear members 141 comprise mating spline formations.

Carried on each of the bevel gear members 141 for common rotation therewith and for axial movement relative thereto are respective clutch elements 161 each including a conical clutch surface 163 adapted to be engaged by the conical surface 133 of the adjacent clutch part 131 on the cross shaft 125 so as to rotate the cross shaft 125 in response to such engagement. In the particularly illustrated construction, the clutch elements 161 are carried on the bevel gear members 141 by mating spline formations.

Preferably, the clutch elements 161 are biased in the direction toward the adjacent clutch parts 131 by suitable means such as one or more helical springs 165. As a consequence, when the cross shaft 125 is axially shifted, one adjacent pair of concial surfaces 133 and 163 is initially engaged to rotate the cross shaft from the bevel gear member 143. Continued axial shifting of the cross shaft 125 in the same direction displaces the engaged clutch element 161 axially outwardly relative to the associated bevel gear member 141 against the action of the helical spring 165 and simultaneously effects entry of the non-cylindrical surface 135 of the associated clutch part 131 into the non-cylindrical aperture 153 of the associated bevel gear member 141 so that rotary power can be transmitted through the splined connection between the bevel gear member 141 and the clutch part 131. It is noted that the clutch part 131 is inserted into the aperture 153 of the bevel gear member 141 when both the bevel gear member 141 and the cross shaft 125 are rotating in common as a result of the engagement of the conical surfaces 133 and 163. Thus, the conical clutch engagement serves to initiate common rotation of the cross shaft 125 with the associated bevel gear member 141 but the principal delivery of power from the bevel gear member 141 to the cross shaft 125 is through the splined connection between the bevel gear member 141 and the cross shaft 125.

Means are provided for shifting the cross shaft 125 axially between a first position engaging one of the bevel gear members 141 to afford forward drive, a second or neutral position wherein both bevel gear members 141 are disengaged, and a third position wherein the other one of the bevel gear members 141 is engaged so as to provide rearward drive. In this regard, the cross shaft includes a pair of axially spaced annular shoulders 171 defining an annular groove 173 which receives (See FIG. 3) a forked portion 175 of a shift lever 177.

The shift lever 177 also includes a shaft portion 179 which extends through the forward wall 85 of the fixed portion 19 of the stern drive unit and is supported thereby for arcuate movement. At its forward end, the shaft portion 179 has fixed thereto, inwardly of the boat hull 13 and forwardly of the transom 15, a shift arm 181 which is connectable to any suitable in-boat actuating mechanism (not shown). Accordingly, rocking of the shift lever 177 serves to axially shift the cross shaft 125 between forward drive and neutral and rearward drive positions. As already indicated, lateral shifting of the cross shaft 125 serves initially to engage a pair of the conical clutch surfaces 133 and 163 and to thereafter, during common rotation of the cross shaft 125 and the associated one of the bevel gear members 141, to effect the insertion of the associated clutch part 131 into the aperture 153 of the associated bevel gear member 141.

Power is thereafter transmitted from the cross shaft 125 to the drive shaft 67 by the output bevel gear 126 and the bevel gear 130 fixed to the top of the drive shaft 67. Thus, a forward-neutral-reverse transmission is provided between the input shaft 123 and the drive shaft 67. In addition, it is noted that there is continuous meshing engagement of the gears during all tilt positions of the tiltable and steerable portions 43 and 51 relative to the fixed portion 19.

The disclosed transmission 121 is advantageously capable of delivering relatively large amounts of rotary power without excess wear consequent to engagement of the transmission in forward and reverse drives. In addition, transmission of power is continuous, notwithstanding tilting.

The steering arrangement avoids sliding engagement between the pins 103 and the slots 101 when tilting at a 0° steering angle, i.e., when traveling straight ahead, and minimizes sliding engagement therebetween consequent to tilting operation at steering angles of less than 45°. In addition, the pin and slot steering connections permit tilting movement which is unlimited by the steering connection. In addition, it is noted that the tilting, steering, and transmission connections are provided within the housing 83 defined by the upper and lower housing parts 77 and 79.

Various of the features of the invention are set forth in the following claims.

What is claimed is:

1. A stern drive unit comprising a first portion adapted to be fixed relative to a boat hull and extending aft of the transom of the boat hull, a second portion, means supporting said second portion from said first portion for movement relative to said first portion about a horizontally extending transverse tilt axis, a third portion, means supporting said third portion from said second portion for common tilting movement and for rotation of said third portion relative to said second portion about a steering axis perpendicular to said tilt axis, said third portion including a propeller shaft, a propeller carried by said propeller shaft and normally located under water, a drive shaft, and gearing connecting said drive shaft and said propeller shaft, an input shaft rotatably supported by said first portion, and a transmission including a cross shaft supported by said first portion for rotary movement coaxial with said tilt axis and for axial movement relative to said first portion, an output gear mounted by said second portion for rotation in coaxial relation to said cross shaft, against movement axially relative to said second portion, and in driving connection with said drive shaft, means on said output gear and on said cross shaft for effecting common rotary movement of said cross shaft and said output gear and permitting axial movement of said cross shaft relative to said output gear, a driving member driven by said input shaft and supported by said first portion in co-axial relation to said cross shaft, means on said driving member and on said cross shaft for selectively coupling said driving member to said cross shaft for common rotary movement in response to axial movement in one direction of said cross shaft, and means on said first portion and operatively engaged with said cross shaft for selectively axially shifting said cross shaft so as thereby to rotationally couple said driving member and said cross shaft.

2. A stern drive unit in accordance with claim 1 wherein said cross shaft includes a clutch part having a conical clutch surface and a non-cylindrical surface, wherein said driving member comprises a bevel gear member including a bevel gear portion in mesh with a driving bevel gear fixed on said input shaft and an apertured portion having a non-cylindrical surface adapted to drivingly receive said non-cylindrical surface of said clutch part of said cross shaft in response to axial movement of said cross shaft toward said bevel gear member, and a clutch element mounted on said bevel gear member for common rotary movement and for relative axial movement therebetween and including a conical clutch surface adapted to engage and to drive said clutch surface of said clutch part of said cross shaft in response to movement of said cross shaft toward said bevel gear member and prior to receipt of said non-cylindrical surface of said clutch part by said non-cylindrical surface of said bevel gear member, whereby axial shifting of said cross shaft initially engages said conical surfaces to rotate said cross shaft in common with said bevel gear member and thereafter engages said non-cylindrical surfaces in driving engagement.

3. A stern drive unit in accordance with claim 2 and further including means yieldably biasing said clutch element in the direction toward said clutch part of said cross shaft.

4. A stern drive unit in accordance with claim 1 wherein said means for selectively axially shifting said cross shaft comprises an annular groove in said cross shaft and a shifting lever rotatably mounted on said first portion and including, at one end, a part extending forwardly of said first portion and, at the other end, a part engaged in said annular groove, whereby accurate movement of said shifting lever effects axial movement of said cross shaft.

5. A stern drive unit in accordance with claim 1 wherein said means for effecting common rotary movement of said cross shaft and said output gear comprises mating spline formations.

6. A stern drive unit in accordance with claim 1 wherein said means for supporting said second portion from said first portion comprises a pair of laterally spaced co-axial trunnion parts extending from said first portion and each having an inner cylindrical surface and an outer cylindrical surface, wherein said second part is rotatably mounted on said outer cylindrical surfaces, wherein said driving member is rotatably mounted on one of said inner surfaces, and wherein said cross shaft is supported by said trunnion parts.

7. A stern drive unit in accordance with claim 1 wherein said first portion includes a generally downwardly and rearwardly open partially spherical first housing part, and wherein said third portion has mounted thereon a generally upwardly and forwardly open partially spherical second housing part movably engaged with said first housing part to define a housing containing said transmission and said means pivotally supporting said second portion from said first portion, and wherein said input shaft, said drive shaft and said cross shaft shifting means extend into said housing.

8. A stern drive unit in accordance with claim 7 and further including an O-ring supported by one of said housing parts and engaging the other of said housing parts to seal said housing.

9. A stern drive unit in accordance with claim 1 and further including means for steering said third portion relative to said second portion comprising a linkage including a steering member rotatably supported by said first portion about an axis co-planar with said steering axis and means located co-axially with said tilt axis when said third portion is located for straight ahead movement for connecting said steering member and said third portion so as to effect steering of said third portion in response to steering movement of said steering member.

10. A stern drive unit in accordance with claim 9 wherein said steering member includes two downwardly extending transversely spaced legs, wherein said third portion includes two transversely spaced upwardly extending arms, and wherein said connecting means is located transversely outwardly of said means tiltably supporting said second portion from said first portion and connects said transversely spaced legs of said steering member with said transversely spaced arms of said third portion for effecting steering movement of said third portion in response to steering movement of said steering member while otherwise permitting lost motion between said legs and said arms.

11. A stern drive unit in accordance with claim 10 wherein said connecting means comprises association of one of said legs with one of said arms and association of the other of said legs with the other of said arms, and wherein in each associated pair of arms and legs there is provided a slot in one of said associated arm and leg and a pin extending from the other of said associated arm and leg and into said slot in said one of said associated arm and leg.

12. A stern drive unit in accordance with claim 9 wherein said first portion includes a generally downwardly and rearwardly open partially spherical first housing part, and wherein said third portion has mounted thereon a generally upwardly and forwardly open partially spherical second housing part movably engaged with said first housing part to define a housing containing said transmission, said means pivotally supporting said second portion from said first portion, and said means connecting said steering member and said third portion, and wherein said input shaft, said drive shaft, said cross shaft shifting means and said steering member extend into said housing.

13. A stern drive unit in accordance with claim 12 and further including an O-ring supported by one of said housing parts and engaging the other of said housing parts to seal said housing.

14. A stern drive unit in accordance with claim 1 and further including a second driving member driven by said input shaft in the direction opposite to said first mentioned driving member and supported by said first portion in spaced relation from said first mentioned driving member and in co-axial relation to said cross shaft and further including means on said second driving member and on said cross shaft for selectively coupling said second driving member to said cross shaft for common rotary movement in response to axial movement of said cross shaft in the direction opposite to said one direction, whereby said transmission is shiftable between forward, reverse, and neutral conditions.

15. A marine propulsion device including a support adapted to be fixed to a boat hull, a cross shaft mounted by said support for rotary and axial movement relative to said support, an output gear mounted by said support for rotation in co-axial relation to said cross shaft and against movement axially relative to said support, means on said output gear and on said cross shaft for effecting common rotary movement of said cross shaft and said output gear and permitting axial movement of said cross shaft relative to said output gear, a driving member mounted by said support for rotation relative to said support by a power source and located in co-axial relation to said cross shaft, means on said driving member and on said cross shaft for selectively coupling said driving member to said cross shaft for common rotary movement in response to axial movement in one direction of said cross shaft, means mounted by said support and operatively engaged with said cross shaft for selectively axially shifting said cross shaft so as thereby to rotationally couple said driving member and said cross shaft, a propeller, and means drivingly connecting said output gear to said propeller.

16. A marine propulsion device in accordance with claim 15 wherein said cross shaft includes a clutch part having a conical clutch surface and a non-cylindrical surface, wherein said driving member comprises a bevel gear member including a bevel gear portion in mesh with a driving bevel gear, and an apertured portion having a non-cylindrical surface adapted to drivingly receive said non-cylindrical surface of said clutch part of said cross shaft in response to axial movement of said cross shaft toward said bevel gear member, and a clutch element mounted on said bevel gear member for common rotary movement and for relative axial movement therebetween and including a conical clutch surface adapted to engage and to drive said clutch surface of said clutch part of said cross shaft in response to movement of said cross shaft toward said bevel gear member and prior to receipt of said non-cylindrical surface of said clutch part by said non-cylindrical surface of said bevel gear member, whereby axial shifting of said cross shaft initially engages said conical surface to rotate said cross shaft in common with said bevel gear member and thereafter engages said non-cylindrical surfaces in driving engagement.

17. A marine propulsion device in accordance with claim 16 and further including means yieldably biasing said clutch element in the direction toward said clutch part of said cross shaft.

18. A marine propulsion device in accordance with claim 15 wherein said means for selectively axially shifting said cross shaft comprises an annular groove in said cross shaft and a shifting lever rotatably mounted on said support and including, at one end, a part extending forwardly of said support and, at the other end, a part engaged in said annular groove, whereby arcuate movement of said shifting lever effects axial movement of said cross shaft.

19. A marine propulsion device in accordance with claim 15 wherein said means for effecting common rotary movement of said cross shaft and said output gear comprises mating spline formations.

20. A marine propulsion device in accordance with claim 15 wherein said support comprises a pair of spaced co-axial parts each having an inner cylindrical surface and a co-axial aperture, wherein said driving member is rotatably mounted on one of said inner surfaces, and wherein said cross shaft is supported by said apertures.

21. A marine propulsion device in accordance with claim 15 and further including a second driving member driven by said input shaft in the direction opposite to said first mentioned driving member and supported by said support in spaced relation from said first mentioned driving member and in co-axial relation to said cross shaft and further including means on said second driving member and on said cross shaft for selectively coupling said second driving member to said cross shaft for common rotary movement in response to axial movement of said cross shaft in the direction opposite to said one direction, whereby to afford shifting between forward, reverse, and neutral conditions.

22. A marine propulsion device in accordance with claim 21 wherein said cross shaft also includes a second clutch part spaced from said first mentioned clutch part and having a conical clutch surface and a non-cylindrical surface, wherein said second driving member comprises a second bevel gear member including a bevel gear portion in mesh with said driving bevel gear and an apertured portion having a non-cylindrical surface adapted to drivingly receive said non-cylindrical surface of said second clutch part of said cross shaft in response to axial movement of said cross shaft toward said second bevel gear member, and a second clutch element mounted on said second bevel gear member for common rotary movement and for relative axial movement therebetween and including a conical clutch surface adapted to engage and to drive said clutch surface of said second clutch part of said cross shaft in response to movement of said cross shaft toward said second bevel gear member and prior to receipt of said non-cylindrical surface of said second clutch part by said non-cylindrical surface of said second bevel gear member, whereby axial shifting of said cross shaft in the direction toward said second bevel gear member initially engages said conical surfaces of said second clutch part and said second bevel gear member to rotate said cross shaft in common with said second bevel gear member and thereafter drivingly engages said non-cylindrical surfaces of said second bevel gear member and said second clutch part.

23. A marine propulsion device in accordance with claim 22 and further including means yieldably biasing said second clutch element in the direction toward said second clutch part of said cross shaft.

24. A stern drive unit comprising a first portion adapted to be fixed relative to a boat hull and extending aft of the transom of the boat hull, a second portion, means supporting said second portion from said first portion for movement relative to said first portion about a horizontally extending transverse tilt axis, a third portion supported by said second portion for common tilting movement and for rotation of said third portion relative to said second portion about a steering axis perpendicular to said tilt axis, and means for steering said third portion relative to said second portion comprising a linkage including a steering member rotatably supported by said first portion about an axis co-planar with said steering axis, and means located transversely outwardly of said means tiltably supporting said second portion from said first portion for connecting said steering member and said third portion so as to effect steering of said third portion in response to steering movement of said steering member.

25. A stern drive unit in accordance with claim 24 wherein said steering member includes two downwardly extending transversely spaced legs, wherein said third portion includes two transversely spaced upwardly extending arms, and wherein said connecting means is located co-axially with said tilt axis when said third portion is located for straight ahead movement and connects said transversely spaced legs of said steering member with said transversely spaced arms of said third portion for effecting steering movement of said third portion in response to steering movement of said steering member while otherwise permitting lost motion between said legs and said arms.

26. A stern drive unit in accordance with claim 25 wherein said connecting means comprises association of one of said legs with one of said arms and association of the other of said legs with the other of said arms, and wherein in each associated pair of arms and legs there is provided a slot in one of said associated arm and leg and a pin extending from the other of said associated arm and leg and into said slot in said one of said associated arm and leg.

* * * * *